US010718241B2

(12) United States Patent
Demeulenaere et al.

(10) Patent No.: US 10,718,241 B2
(45) Date of Patent: Jul. 21, 2020

(54) ENGINE HOUSING COMPONENT

(71) Applicant: Ford Global Technologies, LLC, Dearborn, MI (US)

(72) Inventors: Xavier Demeulenaere, London (GB); Graham Slaughter, Brentwood (GB); Mark Michel, Dartford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 252 days.

(21) Appl. No.: 15/880,272

(22) Filed: Jan. 25, 2018

(65) Prior Publication Data

US 2018/0223707 A1 Aug. 9, 2018

(30) Foreign Application Priority Data

Feb. 7, 2017 (GB) ..... 1701993.6

(51) Int. Cl.
*F01M 11/02* (2006.01)
*F01M 13/04* (2006.01)
(Continued)

(52) U.S. Cl.
CPC ..... *F01M 11/02* (2013.01); *F01M 11/0004* (2013.01); *F01M 13/0405* (2013.01);
(Continued)

(58) Field of Classification Search
CPC ..... F01M 11/0004; F01M 11/02; F01M 13/0405; F01M 13/0416;
(Continued)

(56) References Cited

U.S. PATENT DOCUMENTS 4,947,812 A 8/1990 Inoue et al.
2003/0015164 A1 1/2003 Cho
(Continued)

FOREIGN PATENT DOCUMENTS

CN 201110209 Y 9/2008
DE 4420066 C1 7/1995
(Continued)

OTHER PUBLICATIONS

European Patent Office, Extended European Search Report Issued in Application No. 18150526.4, dated Jun. 11, 2018, Germany, 7 pages.

(Continued)

*Primary Examiner* — Terry K Cecil
(74) *Attorney, Agent, or Firm* — Geoffrey Brumbaugh; McCoy Russell LLP

(57) ABSTRACT

An engine housing component is provided, the housing component defining two or more drain channels configured to receive oil separated from a crankcase ventilation system and to drain said oil through the housing component, wherein the engine housing component comprises two or more drain features, each of the drain features corresponding to one of the drain channels, wherein each of the drain features is configured to allow an oil drain pipe to be coupled to the drain feature such that the oil drain pipe is in fluid communication with the corresponding drain channel, wherein a first drain feature differs from the or each of the other drain features, such that a particular oil drain pipe configured to couple to the first drain feature is not couplable to the other drain features. An engine housing assembly and kit of oil drain pipes is also provided.

20 Claims, 7 Drawing Sheets

(51) Int. Cl.
*F01M 11/00* (2006.01)
*F01M 11/03* (2006.01)

(52) U.S. Cl.
CPC . *F01M 13/0416* (2013.01); *F01M 2011/0033* (2013.01); *F01M 2011/023* (2013.01); *F01M 2011/038* (2013.01); *F01M 2013/0488* (2013.01)

(58) Field of Classification Search
CPC ..... F01M 2011/0033; F01M 2011/023; F01M 2011/038; F01M 2013/0488
See application file for complete search history.

(56) References Cited

U.S. PATENT DOCUMENTS

| | | | |
|---|---|---|---|
| 2004/0244783 | A1 | 12/2004 | Ookawa et al. |
| 2008/0011264 | A1 | 1/2008 | Kawamura et al. |

FOREIGN PATENT DOCUMENTS

| | | | |
|---|---|---|---|
| EP | 0599095 | A1 | 6/1994 |
| EP | 3034823 | A1 | 6/2016 |
| FR | 2075754 | A5 | 10/1971 |
| JP | 2001234725 | A | 8/2001 |
| KR | 20090107754 | A | 10/2009 |

OTHER PUBLICATIONS

Intellectual Property Office of the United Kingdom, Combined Search and Examination Report Issued in Application No. GB1701993.6, dated Apr. 28, 2017, South Wales, 6 pages.

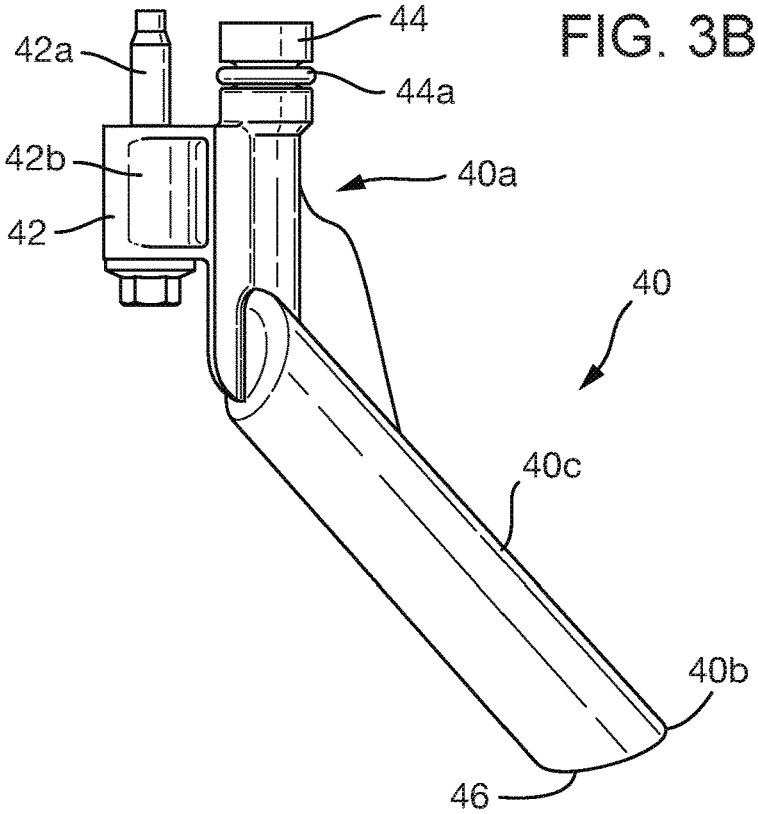
FIG. 3B
FIG. 3C
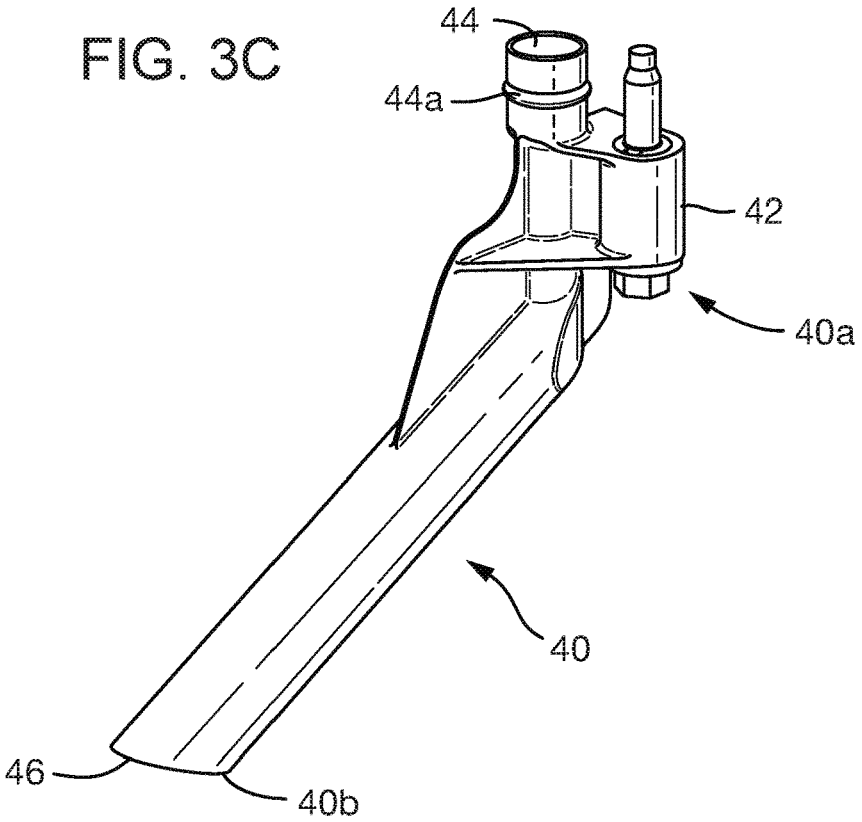

ENGINE HOUSING COMPONENT

CROSS REFERENCE TO RELATED APPLICATION

The present application claims priority to Great Britain Patent Application No. 1701993.6, filed Feb. 7, 2017. The entire contents of the above-referenced application are hereby incorporated by reference in its entirety for all purposes.

TECHNICAL FIELD

The present disclosure relates to an engine housing component and is particularly, although not exclusively, concerned with an engine housing component configured to reduce the number of components stored and managed on a vehicle production line.

BACKGROUND AND SUMMARY

During operation of an engine assembly, small amounts of gases may leak out of the cylinders of the engine into the engine crankcase. Such gases are referred to as blow-by gases. In order to prevent a build-up of blow-by gases within the crankcase, engines typically comprise a crankcase ventilation system, such as a Positive Crankcase Ventilation (PCV) system, configured to extract gases from within the crankcase. The PCV system utilizes a low pressure created in the intake system of the engine assembly to draw the blow-by gases out of the crankcase. The extracted gases may be reintroduced into the inlet of the engine assembly.

The blow-by gases may contain oil, e.g. oil mist. It may be undesirable for the oil to be reintroduced to the inlet of the engine assembly. Hence, the PCV system may comprise an oil separator configured to separate the oil from the gases. The separated oil may be returned to an oil sump of the engine assembly.

The blow-by gases are typically extracted from the crankcase at a cylinder head of the engine assembly and the oil separator may be mounted on or close to the cylinder head. The oil that has been separated from the blow-by gases by the oil separator may drain back through an oil drain passage formed in one or more housings of the engine assembly to an oil sump.

For some configurations of engine assembly, such as a naturally aspirated engine assembly, the PCV system may comprise a single oil separator and the separated oil may drain back to the sump via a single oil drain passage formed within housings of the engine assembly. For other configurations of engine assembly, such as a turbocharged engine assembly, the PCV system may comprise two oil separators and two oil drain channels may be formed within the housings to allow the oil from each of the oil separators to drain back to the oil sump of the engine assembly.

According to an aspect of the present disclosure, there is provided an engine housing component, the housing component defining two or more drain channels configured to receive oil separated from a crankcase ventilation system and to drain said oil through the housing component, wherein the engine housing component comprises two or more drain features, each of the drain features corresponding to one of the drain channels, wherein each of the drain features is configured to allow an oil drain pipe to be coupled to the drain feature such that the oil drain pipe is in fluid communication with the corresponding drain channel, wherein a first drain feature differs from the or each of the other drain features, such that a particular oil drain pipe configured to couple to the first drain feature is not couplable to the other drain features.

Each of the drain features may comprise: a drain port in fluid communication with the corresponding drain channel; and a coupling separate from the drain port, wherein the coupling is configured to allow the oil drain pipe to be coupled to the drain feature.

The configuration, e.g. the size and/or shape, of the drain port of the first drain feature may be different from the configuration of the drain port of the other drain features. Additionally or alternatively, the configuration, e.g. the size and/or shape, of the coupling of the first drain feature may be different from the configuration of the coupling of the other drain features. Additionally or alternatively again, the relative positions of the drain port and coupling of the first drain feature may be different from the relative positions of the drain ports and couplings of each of the other drain features. For example, a distance, e.g. a center distance, between the coupling and drain port of the first drain feature may differ from the distance between the couplings and drain ports of the other drain features.

The coupling may comprise a bore configured to receive a fastener provided on the drain tube. The bore may comprise a threaded portion and the drain tube fastener may be threaded into the bore.

To avoid unnecessary duplication of effort and repetition of text in the specification, certain features are described in relation to only one or several aspects or embodiments of the disclosure. However, it is to be understood that, where it is technically possible, features described in relation to any aspect or embodiment of the disclosure may also be used with any other aspect or embodiment of the disclosure.

BRIEF DESCRIPTION OF THE DRAWINGS

For a better understanding of the present disclosure, and to show more clearly how it may be carried into effect, reference will now be made, by way of example, to the accompanying drawings, in which:

FIGS. 3A, 3B and 3C, are top, side, and perspective views of a first oil drain pipe according to arrangements of the present disclosure;

FIGS. 1, 3A. 3B. 3C. 4, 6A, 6B, 6C, 7, and 8 are drawing to scale, although other relative dimensions may be used if desired.

DETAILED DESCRIPTION

Figure 1:
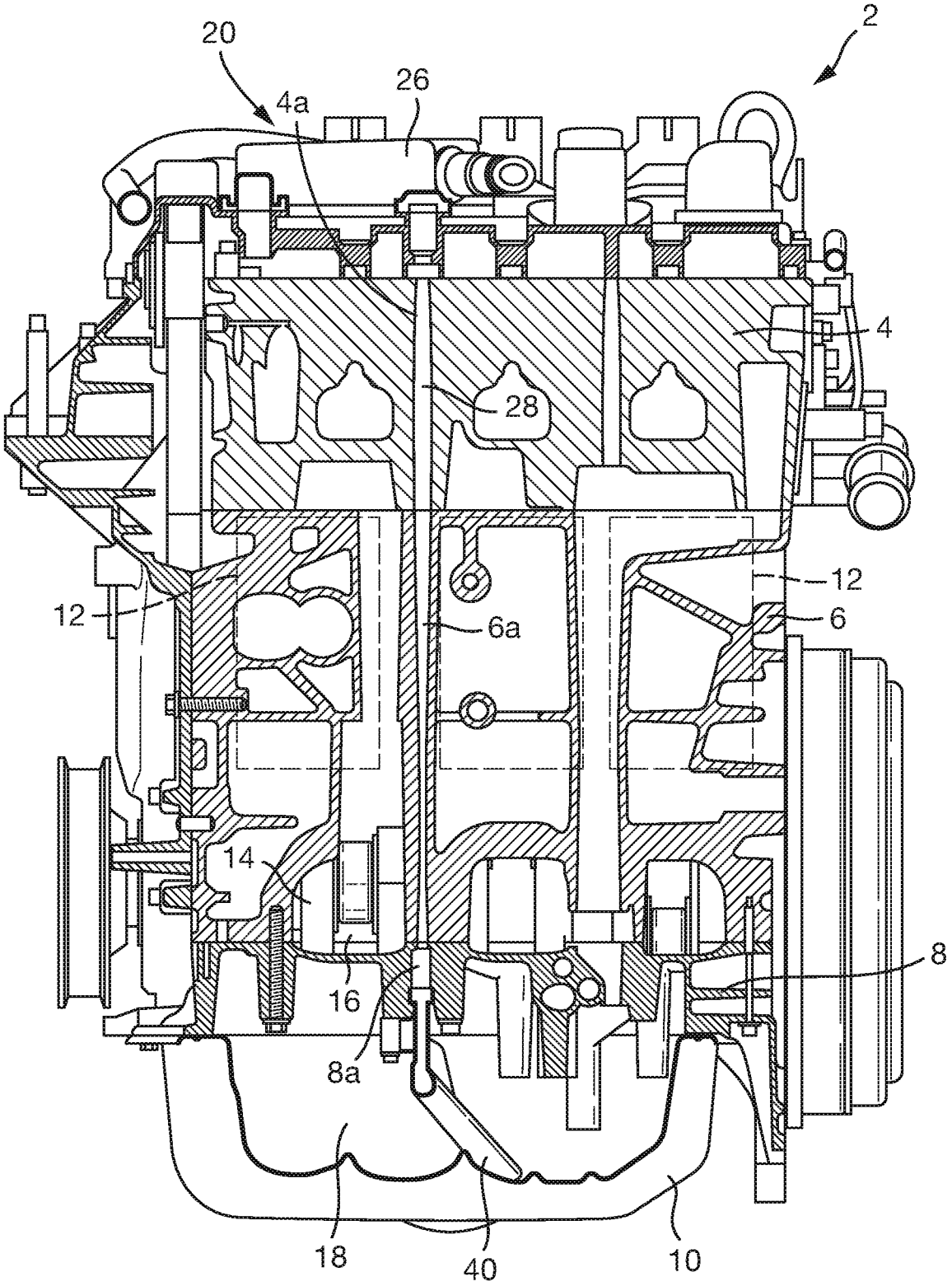
FIG. 1 is a sectional view of an engine assembly according to a first arrangement of the present disclosure.

As noted above, in an aspect of the present disclosure, there is provided an engine housing component, the housing component defining two or more drain channels configured to receive oil separated from a crankcase ventilation system and to drain said oil through the housing component, wherein the engine housing component comprises two or more drain features, each of the drain features corresponding to one of the drain channels, wherein each of the drain features is configured to allow an oil drain pipe to be coupled to the drain feature such that the oil drain pipe is in fluid communication with the corresponding drain channel, wherein a first drain feature differs from the or each of the other drain features, such that a particular oil drain pipe configured to couple to the first drain feature is not couplable to the other drain features.

According to another aspect of the present disclosure, there is provided a housing for an engine assembly, the housing configured to define two or more drain channels configured to permit oil separated from a crankcase ventilation system to drain through the housing, wherein the housing comprises two or more drain features, each of the drain features corresponding to one of the drain channels, wherein the drain features are configured to allow an oil drain pipe to be coupled to the drain feature and arranged in fluid communication with the corresponding drain channel such that the separated oil within the corresponding drain channel can drain through the oil drain pipe to an oil sump of the engine assembly, wherein a first drain feature differs from the others of the drain features, such that a particular oil drain pipe configured to couple to the first drain feature is not couplable to the other drain features.

An engine housing assembly may comprise the above-mentioned engine housing component and a first oil drain pipe coupled to the first drain feature. The first oil drain pipe may not be couplable to the or each of the other drain features.

The first oil drain pipe may comprise a fastener configured to couple the first oil drain pipe to the first drain feature. The fastener may be captive on the first oil drain pipe prior to assembly. The first oil drain pipe may further comprise a pipe portion, configured to receive separated oil from the drain channel corresponding to the first drain feature. The first oil drain pipe may be configured such that the pipe portion is in fluid communication with the corresponding drain channel, e.g. via the corresponding drain port, when the fastener is coupled to the first drain feature.

The first oil drain pipe may have a first end and a second end. The first oil drain pipe may further comprise a tubular body extending between the first and second ends. The first end may be coupled to the first oil drain feature. The first oil drain pipe, e.g. the tubular body, may be configured such that the second end of the first oil drain pipe is positioned within an oil sump at or adjacent to the deepest, e.g. lowest, point of the oil sump. The second end of the first oil drain pipe may be positioned such that it may be below the surface of oil within the oil sump at substantially all engine running conditions. The oil sump may be at least partially defined by the housing, e.g. the housing may define a wall or lid of the oil sump.

The assembly may further comprise a second oil drain pipe coupled to a second oil drain feature of the engine housing component. The second oil drain pipe may not be couplable to the first oil drain feature.

The second oil drain pipe may comprise a fastener configured to couple the second oil drain pipe to the second drain feature. The second oil drain pipe may further comprise a pipe portion configured to receive separated oil from the oil channel corresponding to the second drain feature. The second oil drain pipe may be configured such that the pipe portion is in fluid communication with the corresponding drain channel when the fastener is coupled to the second drain feature.

A distance between the fastener and the pipe portion of the first oil drain pipe may be different from the distance between the fastener and the pipe portion of the second oil drain pipe.

The second oil drain pipe may have a first end and a second end. A tubular body of the second oil drain pipe may extend between the first and second ends. The first end may be coupled to the second oil drain feature. The second oil drain pipe, e.g. the tubular body, may be configured such that the second end of the second oil drain pipe is positioned within the oil sump at or adjacent to the deepest, e.g. lowest, point of the oil sump. The second end of the first oil drain pipe may be positioned below the surface of oil within the oil sump at substantially all operating condition of the engine. The second end of the second oil drain pipe may be positioned adjacent to, or may be spaced apart from, the second end of the first oil drain pipe.

According to another aspect of the present disclosure, there is provided a kit of oil drain pipes for coupling to an engine housing component, the oil pipes being configured to couple to an oil drain feature of the housing component to allow oil separated from a crankcase ventilation system to drain through a drain channel defined in the housing into the oil drain pipe, wherein each of the oil drain pipes has a first end comprising a fastening portion, configured to couple the oil drain pipe to the oil drain feature, and a tubular portion, configured to receive the separated oil from the drain channel, wherein the configurations, e.g. the size and/or shape, of the first end of a first oil drain pipe is different from the configuration of the first end of the other oil drain pipes in the kit.

In other words, a first oil drain pipe in the kit may be couplable to a first oil drain feature of the housing and the other oil drain pipes in the kit may not be couplable to the first oil drain feature.

The size and/or shape of the first end of the first oil drain pipe may differ in that the relative positions of the fastening portion and tubular portion of the first oil pipe may be different from the other oil drain pipes in the kit. For example, a distance, e.g. a center distance, between the fastening portion and the tubular portion of the first oil drain pipe may be different from the other oil drain pipes in the kit.

The fastening portion may comprise a fastener provided on the oil drain pipe. The fastener may be captive on the oil drain pipe prior to the oil drain pipe being coupled to the oil drain feature.

The fastener may be provided on a boss. The boss may be formed integrally with the pipe portion of the oil drain pipe. A length of the boss may vary between the different oil drain pipes in the kit, e.g. such that the relative positions of the fastening portion and the pipe portion is varied.

With reference to FIG. 1, an engine assembly 2 for a vehicle, such as a motor vehicle, comprises a plurality of engine housings, such as a cylinder head 4, a cylinder block 6, a ladder frame 8 and a sump pan 10.

The cylinder block 6 defines one or more cylinders 12 of the engine assembly 2. Combustion of fuel and air within the cylinders produces expanding gases which act upon pistons (not shown) within the cylinders to drive a crank shaft 14 of the engine assembly. After the pistons have been displaced by the expanded combustion gases, the combustion gases are exhausted from the cylinders 12.

The cylinder head 4 defines a plurality of inlet and exhaust valves (not shown) configured to control the flow of inlet air and exhaust gases into and out of the cylinders 12 respectively.

The sump pan 10 defines an oil sump 18 of the engine assembly 2 within which oil for the engine is stored prior to being pumped around the engine assembly 2 to lubricate components of the engine assembly 2. Oil which has been pumped to a component of the engine assembly 2 drains back through the engine assembly to return to the oil sump 18.

The ladder frame 8 may be a structural component of the engine assembly configured to provide surfaces for the crank shaft and/or a balance shaft of the engine assembly to be mounted. The ladder frame 8 may comprise one or more stiffening features such as webs and/or ribs.

The crank shaft 14 is disposed within a crankcase cavity 16 of the engine assembly. As depicted in FIG. 1, the crankcase cavity 16 may be defined by the cylinder block 6 and the ladder frame 8. During operation of the engine assembly 2, gases produced during combustion within the cylinders may leak past the pistons into the crankcase cavity 16. These gases are known as "blow-by" gases. Leaking of blow-by gases into the crankcase cavity 16 may increase pressure within the cavity. Additionally, it may be undesirable for the combustion products present within the blow-by gases to build up within the crankcase cavity 16.

In order to maintain a desirable pressure within the crankcase cavity 16 and/or to prevent the build-up of blow-by gases within the crankcase cavity, the engine assembly 2 may comprise a crankcase ventilation system, such as a Positive Crankcase Ventilation (PCV) system 20, configured to draw gases out of the crankcase cavity.

Figure 2:
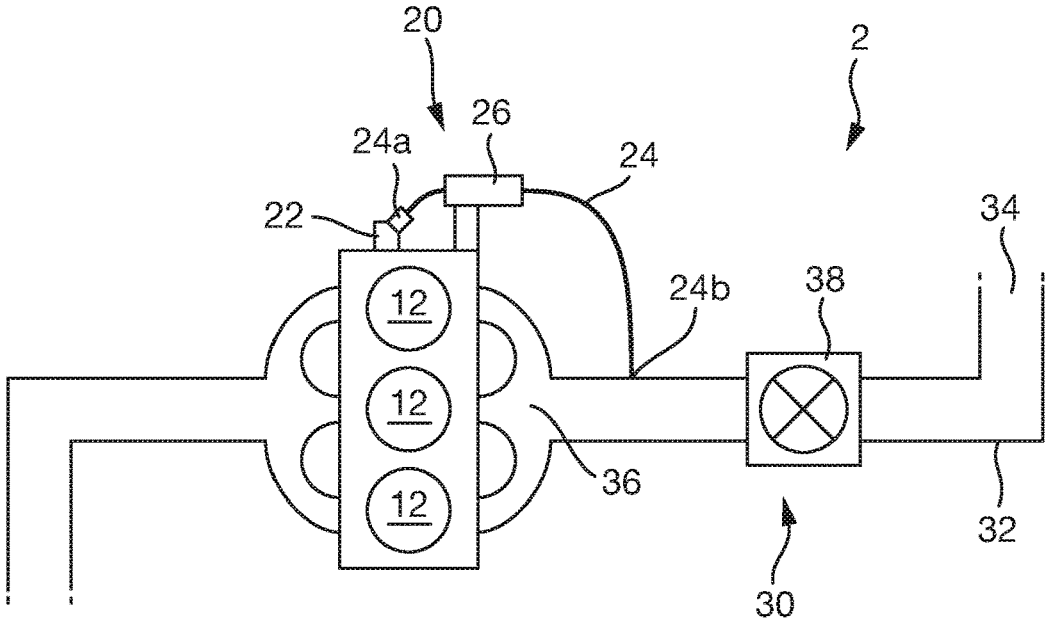
FIG. 2 is a schematic view of an engine assembly according to the first arrangement of the present disclosure.

With reference to FIG. 2, the PCV system 20 may comprise a PCV valve 22 and a breather tube 24. The PCV valve 22 may be arranged in fluid communication with the crankcase cavity 16 (depicted in FIG. 1) and configured to control the flow of gases out of the crankcase cavity. A first end 24*a* of the breather tube 24 may be coupled to the PCV valve 22 and a second end 24*b* of the breather tube may be arranged in fluid communication with inlet air within an intake system 30 of the engine assembly. In this way, gases drawn out of the crankcase cavity 16 by the PCV system 20 may be vented into the intake system 30.

The intake system 30 may comprise an intake duct 32 configured to carry inlet air from an air inlet 34 to an inlet manifold 36. Air may be drawn from the inlet manifold 36 into the cylinders 12 of the engine assembly 2. The intake system 30 further comprises an inlet throttle 38 provided on the intake duct 32 and configured to control the flow of inlet air within the intake duct 32. Due to the presence of the inlet throttle 38 and the operation of engine assembly, a pressure of the inlet air downstream of the inlet throttle 38, e.g. within the inlet manifold 36, may be less than a pressure of inlet air at the air inlet 34. In other words, a vacuum may be generated within the intake system 30 downstream of the inlet throttle 38.

As depicted in FIG. 2, the breather tube 24 of the PCV system may be in fluid communication with the intake system 30 at a position on the intake duct 32 downstream of the inlet throttle 38. The vacuum pressure within the intake system 30 may thereby be utilized by the PCV system 20 to draw gases out of the crankcase via the PCV valve 22.

The gases extracted from the crankcase cavity 16 may comprise oil, e.g. oil mist, suspended within the gases. It may be undesirable for the oil to be vented into the intake system 30. Oil that is vented into the intake system may be combusted within the cylinders 12 of the engine assembly, which may reduce the amount of oil available to lubricate the engine, as well as increasing emissions from the engine assembly 2. In order to limit oil from being vented into the intake system, the PCV system 20 may comprise an oil separator 26. The oil separator may be operatively provided on the breather tube 24 between the PCV valve 22 and the intake system 30. The oil separator 26 may be configured to separate the oil from the extracted gases and return the oil to the oil sump 18 (depicted in FIG. 1) of the engine, as described below.

Returning to FIG. 1, the oil separator 26 may be mounted on or close to the cylinder head 4 of the engine assembly 2. An oil drain passage 28 may be defined within the engine assembly 2 to allow separated oil from the oil separator 26 to drain back towards the oil sump 18. For example, as depicted in FIG. 1, the cylinder head 4, cylinder block 6 and the ladder frame 8 may each define respective oil drain channels 4*a*, 6*a*, 8*a* that form the oil drain passage 28. The oil drain channels formed in each of the engine housing components may be aligned with one another to allow the separated oil to drain though each of the engine housings to the oil sump 18.

In order to allow separated oil to drain through the engine assembly 2 and return to the oil sump effectively, it may be desirable for an outlet of the oil drain passage 28 to be arranged in the oil sump 18 below the minimum level of oil within the oil sump 18. As depicted in FIG. 1, the ladder frame 8 may define an upper interior wall of the oil sump 18. Hence, in order to provide an outlet of the oil drain passage below the level of oil within the oil sump 18, the engine assembly 2 may further comprise an oil drain tube 40. The oil drain tube may extend from the oil drain channel 8*a* defined in the ladder frame 8 into the oil sump 18 and may provide an outlet for the separated oil below the surface of the oil within the oil sump 18.

Figure 3A:
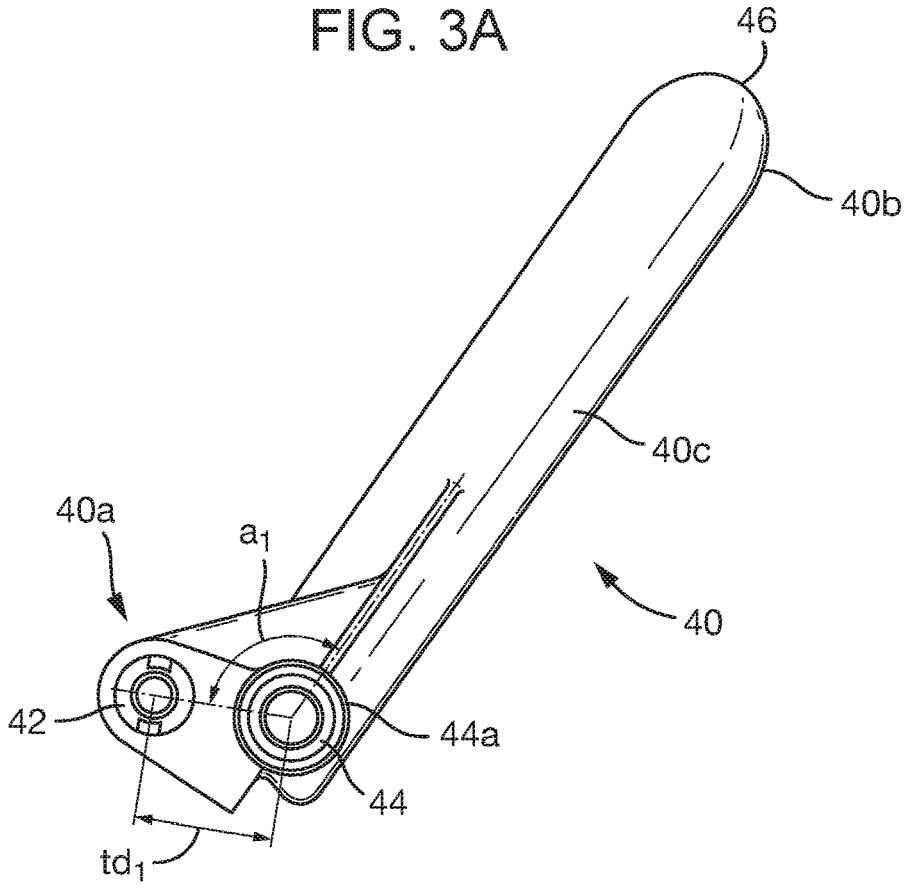

With reference to FIGS. 3A-3C, the oil drain tube 40 has a first end 40*a* and a second end 40*b*. A tubular body 40*c* of the oil drain tube may extend between the first and second ends 40*a*, 40*b*. The tubular body 40*c* may be configured to allow oil to drain through the oil drain tube 40 from the first end 40*a* to the second end 40*b*. The tubular body 40*c* may be a substantially cylindrical tube. Alternatively, the tubular body 40*c* may be a tube of any other desired cross section.

The first end 40*a* of the oil drain tube 40 may comprise a fastening portion 42 and a tubular portion 44. The tubular portion 44 may be in fluid communication with the flow passage of the tubular body 40*c*. The fastening portion 42 may be configured to couple the oil drain tube 40 to the ladder frame 8, such that the tubular portion 44 is in fluid communication with the oil drain channel 8*a* defined in the ladder frame.

The second end 40*b* of the oil drain tube may define an outlet 46 of the oil drain tube. The tubular portion 44 may be in fluid communication with the outlet 46 via the tubular body 40*c*. As depicted in FIG. 1, when the first end 40*a* of the oil drain tube 40 is coupled to the ladder frame 8, the tubular body 40*c* may protrude into the oil sump 18. The oil drain tube 40 may be configured such that the outlet 46 is positioned at or adjacent to the deepest, e.g. lowest, point of the oil sump 18. The outlet 46 may thereby be arranged below the level of oil within the oil sump 18 at substantially all operating conditions of the engine assembly 2.

In the arrangement disclosed in FIGS. 1 and 2, the engine assembly 2 is a naturally aspirated engine assembly. At substantially all operating conditions of the engine assembly 2, a low pressure is generated in the intake system 30 downstream of the throttle 38. Hence, the PCV system 20 may operate at substantially all operating conditions of the engine assembly to extract blow-by gases from the crankcase cavity 16.

Figure 4:
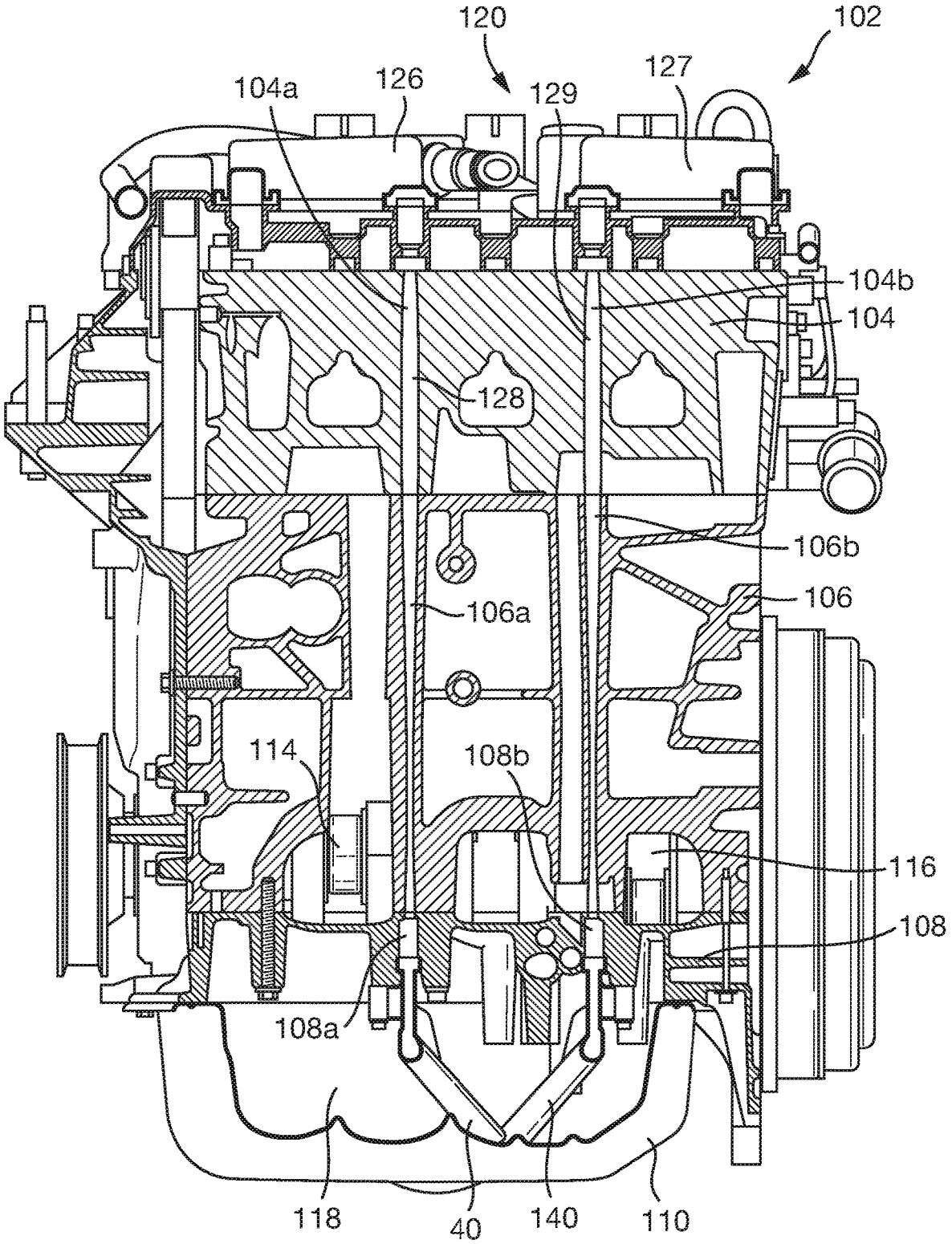
FIG. 4 is a sectional view of an engine assembly according to a second arrangement of the present disclosure.
Figure 5:
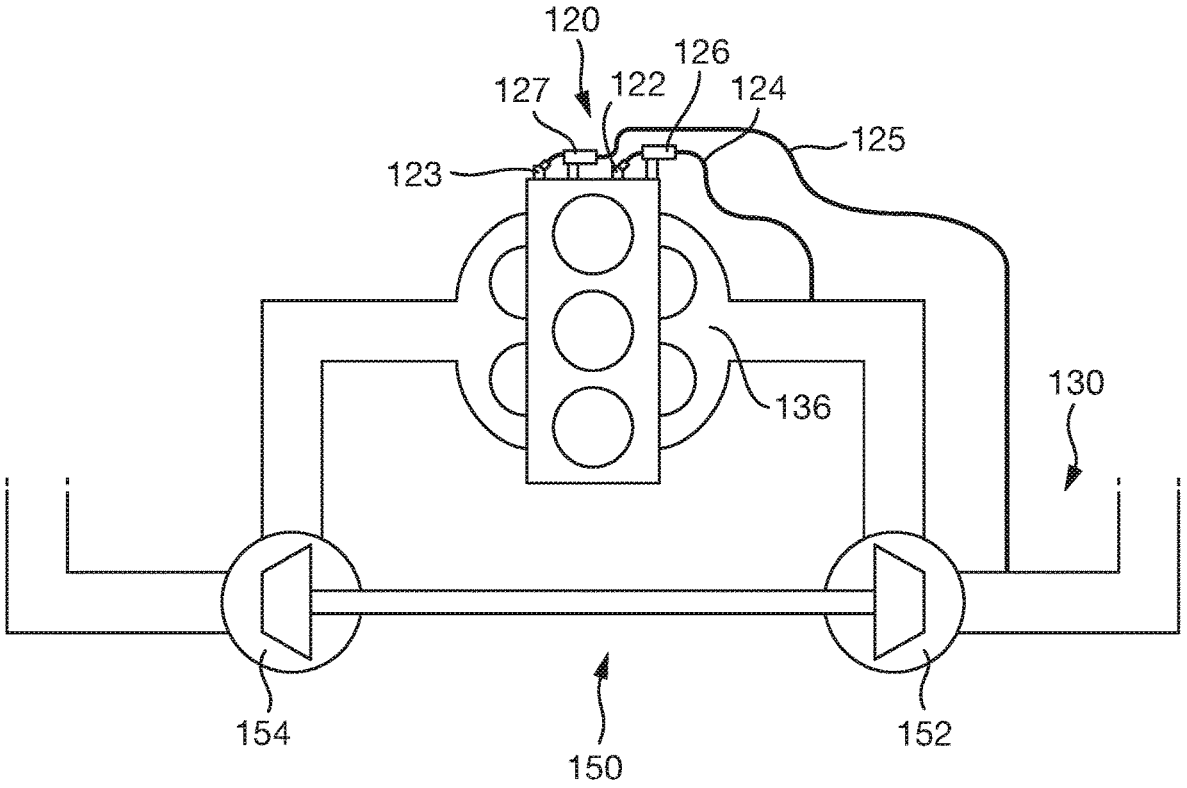
FIG. 5 is a schematic view of an engine assembly according to the second arrangement of the present disclosure.

With reference to FIGS. 4 and 5, an engine assembly 102 according to another arrangement of the present disclosure will now be described. The engine assembly 102 is similar to the engine assembly 2 and comprises a cylinder head 104, a cylinder block 106, a ladder frame 108 and a sump pan 110 configured in the same way as the engine housing components described with reference to FIGS. 1 and 2 and the features described in relation to the engine assembly 2 may equally apply to the engine assembly 102. However, the engine assembly 102 differs from the engine assembly 2 due to the inclusion of a turbocharger 150 within the engine assembly 102.

The turbocharger 150 comprises a turbocharger compressor 152 provided within an intake system 130 of the engine assembly 102. The turbocharger compressor 152 is configured to selectively increase the pressure of inlet gases within the intake system 130. The turbocharger compressor 152 is driven by a turbocharger turbine 154 provided on the same shaft as the turbocharger compressor and arranged within the flow of exhaust gases leaving the engine cylinders. In the arrangement depicted in FIG. 5, the intake system 130 does not comprise an intake throttle, however, in some arrangements an intake throttle may be provided, e.g. upstream of the turbocharger compressor 152.

The engine assembly 102 further comprises a PCV system 120 configured to extract blow-by gases from a crankcase cavity 116 of the engine assembly 102. The PCV system 120 may comprise a PCV valve 122, a breather tube 124 and an oil separator 126 configured in the same way as the PCV valve 22, the breather tube 24 and the oil separator 26 depicted in FIG. 2. When the turbocharger compressor 152 is operating, the pressure of inlet air within an inlet manifold 136 may be high. The pressure within the inlet manifold may be greater that the pressure within the crankcase cavity 116. Hence, the PCV system 120 may not be capable of venting the blow-by gases from the crankcase into the inlet system 130 through the breather tube 124.

As shown in FIG. 5, in order to allow the PCV system 120 to operate when the turbocharger compressor 152 is operating, the PCV system 120 may comprise a further PCV valve 123, a further breather tube 125 and a further oil separator 127. The further PCV valve 123, further breather tube 125 and the further oil separator 127 may be configured in a similar manner to the PCV valve 122, the breather tube 124 and the oil separator 126, except that the further breather tube 125 may be in fluid communication with the inlet system 130 at a position upstream of the turbocharger compressor 152. If the intake system 130 comprises an inlet throttle, the breather tube 124 may be arranged in fluid communication with the intake system at a position downstream of the inlet throttle.

When the turbocharger compressor 152 is not operating, the PCV system 120 may vent the crankcase cavity 116 via the breather tube 124 and/or 125 and when the turbocharger compressor is operating, the PCV system may vent the crankcase cavity 116 via the breather tube 125.

As depicted in FIG. 4, the further oil separator 127 may be mounted on or close to the cylinder head 106. The further oil separator 127 may be mounted adjacent to the oil separator 126 or may be mounted away from the oil separator 126. The engine assembly 102 may define an oil drain passage 128 configured to allow the oil separated by the oil separator 126 to drain back to an oil sump 118 of the engine assembly. The cylinder head 104, cylinder block 106 and ladder frame 108 may each define respective, commonly aligned oil drain channels 104*a*, 106*a*, 108*a* that form the oil drain passage 128.

The oil separated by the further oil separator 127 may drain back to the oil sump together with the oil from the oil separator 126, e.g. via the oil drain passage 128. Alternatively, the engine assembly 102 may define a further oil drain passage 129 configured to allow the oil separated by the further oil separator 127 to drain back to the oil sump 118 separately. The cylinder head, cylinder block and ladder frame may define further oil drain channels 104*b*, 106*b*, 108*b* respectively. As depicted in FIG. 4, the further oil drain channels 104*b*, 106*b*, 108*b* may be aligned with each other to form the further oil drain passage 129.

As described above, it may be desirable for outlets of the oil drain passage 128 and the further oil drain passage 129 to be arranged in the oil sump 118 below the level of oil within the sump. The engine assembly 102, may comprise the oil drain tube 40 described above, the oil drain tube may be coupled to the ladder frame 108, such that the tubular portion 44 is in fluid communication within the oil drain channel 108*a*. The engine assembly 102 may comprise a further oil drain tube 140 coupled to the ladder frame 108.

Figure 6A:
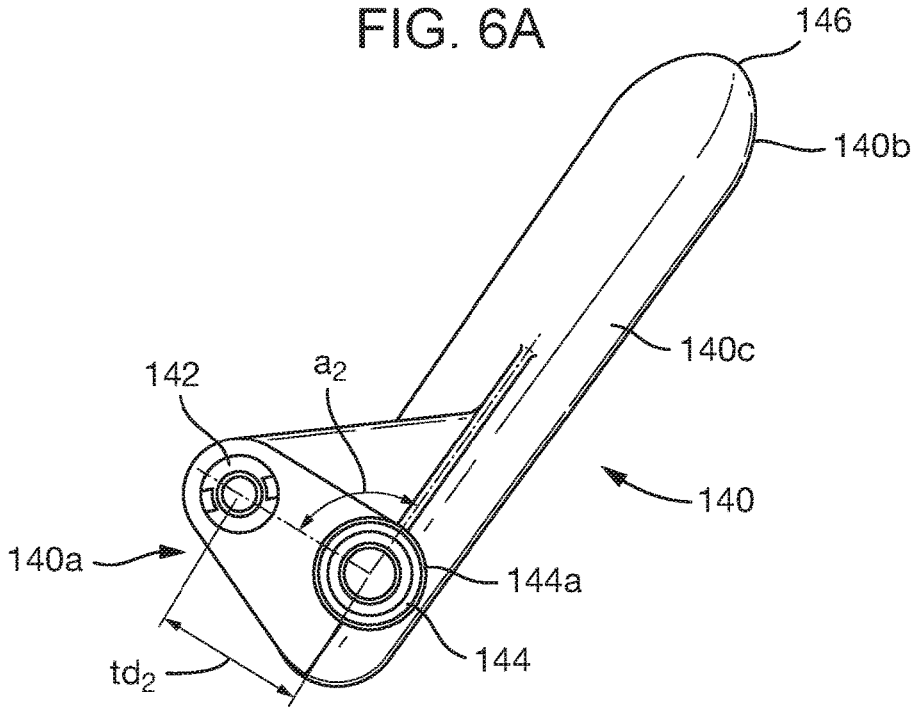
FIGS. 6A, 6B and 6C, are top, side, and perspective views of a second oil drain pipe according to arrangements of the present disclosure.
Figure 6B:
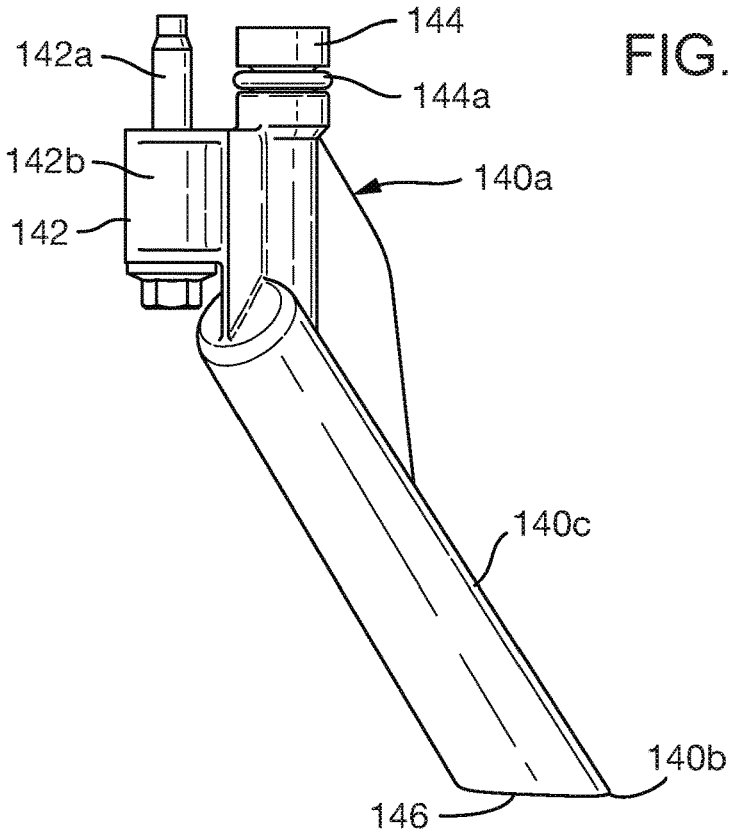
Figure 6C:
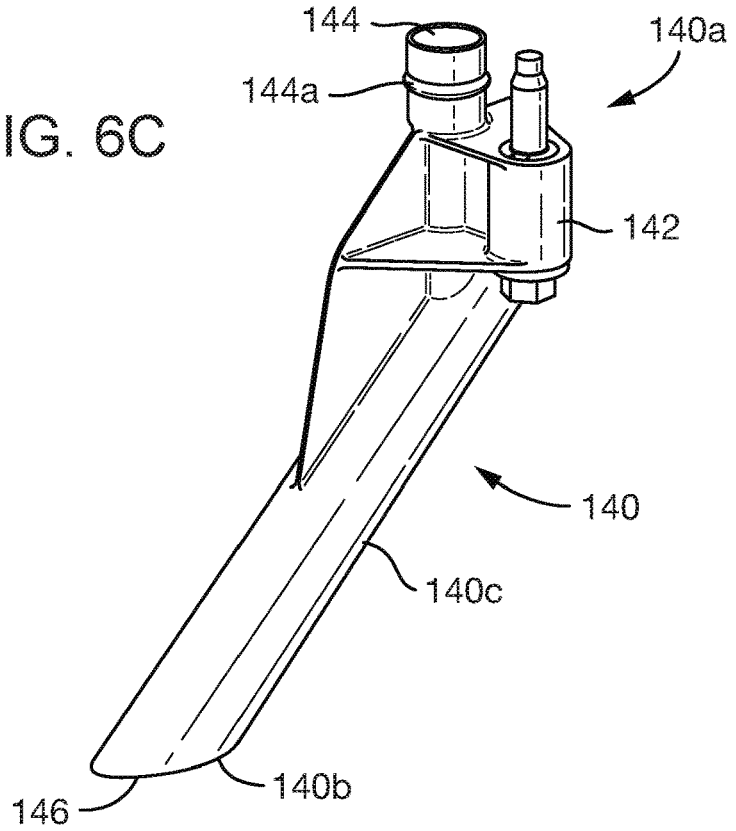

With reference to FIGS. 6A-6C, the further oil drain tube 140 may be similar to the oil drain tube 40 described above, and may have a first end 140*a*, a second end 140*b* and a tubular body 140*c*. The first end 140*a* may comprise a fastening portion 142 and a tubular portion 144. As depicted in FIG. 4, the further oil drain tube may be coupled to the ladder frame 108, e.g. at the fastening portion 142, and the tubular portion 144 of the further oil drain tube may be arranged in fluid communication with the further oil drain channel 108*b*.

Figure 7:
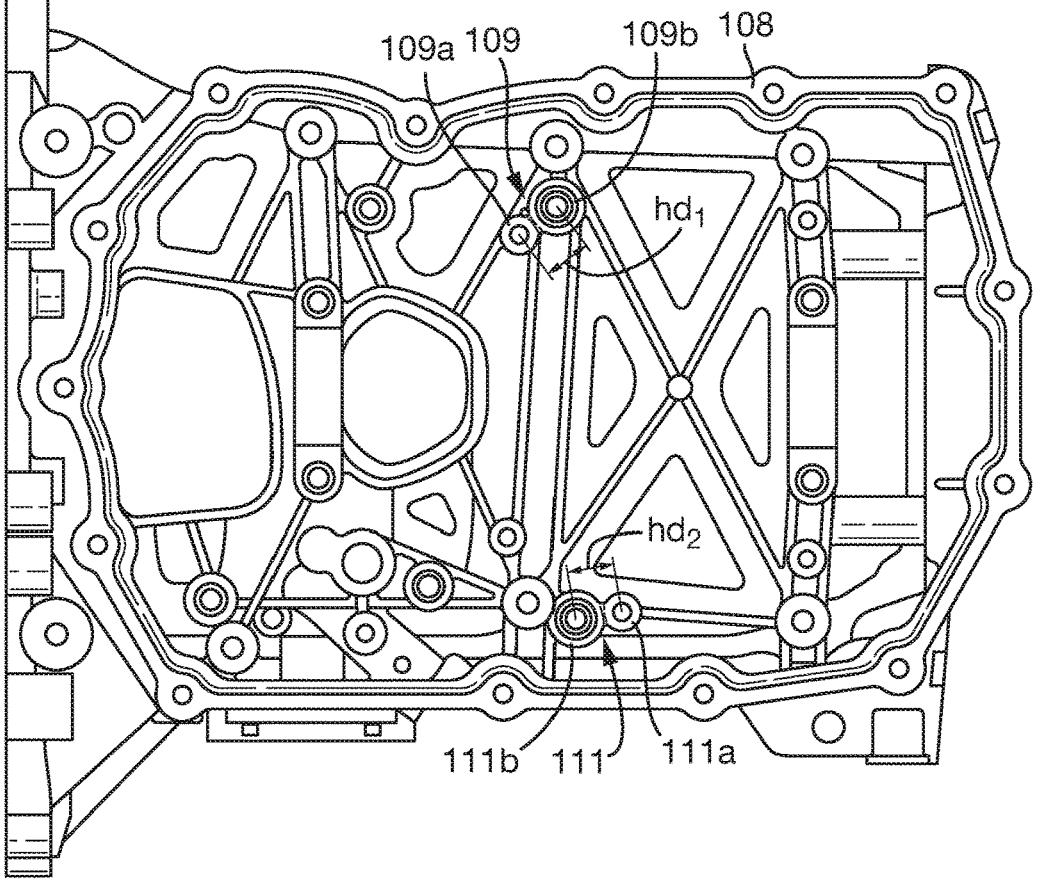
FIG. 7 is a bottom view of a ladder frame according to arrangements of the present disclosure.

With reference to FIG. 7, the ladder frame 108 may comprise an oil drain feature 109 and a further oil drain feature 111. The oil drain features 109, 111 may be provided on and/or between the stiffening features of the ladder frame 108. The oil drain feature 109 may correspond to the oil drain channel 108*a* and the further oil drain feature may correspond to the further oil drain channel 108*b*. The oil drain features 109, 111 may each comprise a coupling portion 109*a*, 111*a* and a drain port 109*b*, 111*b*. The coupling portions 109*a*, 111*a* may be configured to permit the oil drain tubes 40, 140 to be coupled to the ladder frame 108 at the oil drain features 109, 111. For example, the coupling portions 109*a*, 111*a* may comprise a bore configured to receive a fastener provided on the oil drain tube. The bore may comprise a threaded portion.

The drain ports 109*b*, 111*b* of the oil drain feature and further oil drain feature may define outlets of the oil drain channel 108*a* and further oil drain channel 108*b* respectively. The drain ports 109*b*, 111*b* may be configured to couple to the tubular portions 44, 144 of the oil drain tube and further oil drain tube, such that the oil drain tubes are arranged in fluid communication with the oil drain channel 108*a* and further oil drain channel 108*b* respectively.

In some arrangements, the tubular portions 44, 144 may be partially received within the drain ports 109*b*, 110*b*. As depicted in FIGS. 3A-3C and FIGS. 6A-6C, the tubular portions 44, 144 may comprise seals 44*a*, 144*a*, such as O-ring seals, configured to create a seal between the tubular portion and the drain ports. When the tubular portion 44, 144 is received within the drain port 109*b*, 111*b*, the seals 44*a*, 144*a* may be arranged between outer surfaces of the tubular portions 44, 144 and inner surfaces of the respective drain ports 109*b*, 111*b*. It is also envisaged that the opposite arrangement may apply, e.g. with the drain ports received within the tubular portions 44, 144.

The configuration, e.g. the size and/or shape, of the coupling portions 109*a*, 111*a* of the oil drain features 109, 111 may correspond to the size and/or shape of the fastening portions 42, 142 of the oil drain tubes 40, 140 respectively. Similarly, the configuration, e.g. the size and/or shape, of the drain ports 109*b*, 111*b* of the oil drain features 109, 111 may correspond to the size and/or shape of the tubular portions 44, 144 of the oil drain tubes 40, 140 respectively.

Furthermore, the relative positions of the coupling portion 109*a* and drain port 109*b*, may correspond to the relative positions of the fastening portion 42 and tubular portion 44 the oil drain tube 40 and the relative positions of the coupling portion 111*a* and drain port 111*b* may correspond to the relative positions of the fastening portion 142 and tubular portion 144 of the further oil drain tube 140. In other words, the configuration of the oil drain features 109, 111 may correspond to the configuration of the first ends of the oil drain tubes 40, 140. In this way, when the fastening portions 42, 142 of the oil drain tubes are coupled to the coupling portions 109*a*, 111*a*, the tubular portions 44, 144 may be in fluid communication with the oil drain channel 108*a* and further oil drain channel 108*b* respectively.

The configuration, e.g. the size, shape and/or relative positions of the coupling portion 109*a*, 111*a* and drain port 109*b*, 111*b*, of the oil drain features 109 111 may differ. For example, as depicted in FIG. 7, a distance, e.g. a center distance hd1, hd2, between the coupling portion 109*a* and the drain port 109*b* of the oil drain feature 109 may be different to the distance between the coupling portion 111*a* and the drain port 111*b* of the further drain feature 111.

In the arrangement shown in FIG. 7, the size and shape of the coupling portions 109*a*, 111*a* and drain ports 109*b*, 111*b* are the same. However, in other arrangements, the size and shape of the coupling portions 109*a*, 111*a* and/or drain ports 109*b*, 111*b* may differ. For example, the drain port of one of the oil drain features may be circular and the drain port of the other oil drain features may be square or any other shape. Alternatively, the drain ports may each be circular and the diameters of the drain ports may vary. The spacing between the coupling portion and the drain port of a particular drain feature may or may not differ from that of another drain features.

As mentioned above the configuration of the first end of oil drain tube 40, 140 may correspond to the configuration of the oil drain feature 109, 111 to which the oil drain tube couples. Hence, when the configuration of the oil drain feature 109 is different to the configuration of the further oil drain feature 111, the configurations of the first ends of the oil drain tube 40 and further oil drain tube 140 may differ accordingly. For example, as depicted in FIGS. 3A and 6A, distances td1, td2 between the centers of the fastening portions 42, 142 and tubular portions 44, 144 of the oil drain tubes may be different. Hence, the oil drain tube 40 may be couplable to the oil drain feature 109 but may not be couplable to the further oil drain feature 111. Similarly, the further oil drain tube 140 may be couplable to the further oil drain feature 111, but may not be couplable to the oil drain feature 109.

Providing differently configured oil drain features and oil drain tubes within the engine assembly 102 may be beneficial, as it may allow the ladder frame 108 comprising the oil drain feature 109 and the further oil drain feature 111 to be provided on both the naturally aspirated engine assembly 2 and the turbocharged engine assembly 102, whilst ensuring that the oil drain tube 40 is correctly assembled within the engine assembly.

As described above, the PCV system 20 provided on the naturally aspirated engine assembly 2 may comprise a single oil separator 26. Hence, the engine assembly 2 may comprise a single oil drain passage 28 and a single oil drain tube 40. When the ladder frame 108, which comprises the oil drain feature 109 and the further oil drain feature 111, is provided within the engine assembly 2, it is desirable for the oil drain tube 40 to be coupled to the correct oil drain feature, e.g. the oil drain feature corresponding to the oil drain passage 28, in order for the separated oil to drain effectively from the oil separator 26 to the oil sump 18.

If the oil drain feature 109 were configured similarly to the further oil drain feature 111, it may be possible for the oil drain tube 40 to be incorrectly coupled to the further oil drain feature 111. However, when the configuration of the further oil drain feature 111 differs from the configuration of the oil drain feature 109, the oil drain tube 40 may not be couplable to the further oil drain feature 111. This may prevent incorrect assembly of the engine assembly 2.

When the ladder frame 108 is provided within the turbocharged engine assembly 102, the oil drain tube 40 and the further oil drain tube 140 may both be provided within the engine assembly and may be coupled to the oil drain feature 109 and further oil drain feature 111 respectively. The ladder frame 108 may therefore be common to both the engine assembly 2 and the turbocharger engine assembly 102. Hence, the ladder frames 8, 108 may be identical and it may not be necessary for two different ladder frames to be produced, or stored and managed on the production line for the engine assemblies 2, 102. Providing two different designs of oil drain tube 40, 140 may be cheaper and easier to manage than two differently design ladder frames.

Providing dissimilar oil drain features 109, 111 and dissimilar oil drain tube 40, 140 within the engine assembly 102 may be further advantageous, as it may allow the tube bodies 40*c*, 140*c* of the oil drain tubes to be different. For example, the tube bodies may have different lengths and may extend at different angles relative to the first ends 40*a*, 140*a* of the oil drain tubes. For example, as depicted in FIGS. 3A and 6A, an angle a1, a2 of the tubular body may be defined as the angle between a line between the centers of the fastening portion 42, 142 and the tubular portion 44, 144, and a center line of the tubular body 40*c*, 140*c*.

Providing oil drain tubes with tube bodies 40*c*, 140*c* that are arranged at different angles relative to the first ends 40*a*, 140*a* of the drain tubes provides greater flexibility in the design of the oil drain features 109, 110 of the ladder frame 108. In particular, the orientations of the oil drain features may be separately adjusted, as desired, and the angle of the corresponding tubular body adjusted accordingly, such that the relative positions of the outlets 46, 146 within the oil sump are not affected.

Figure 8:
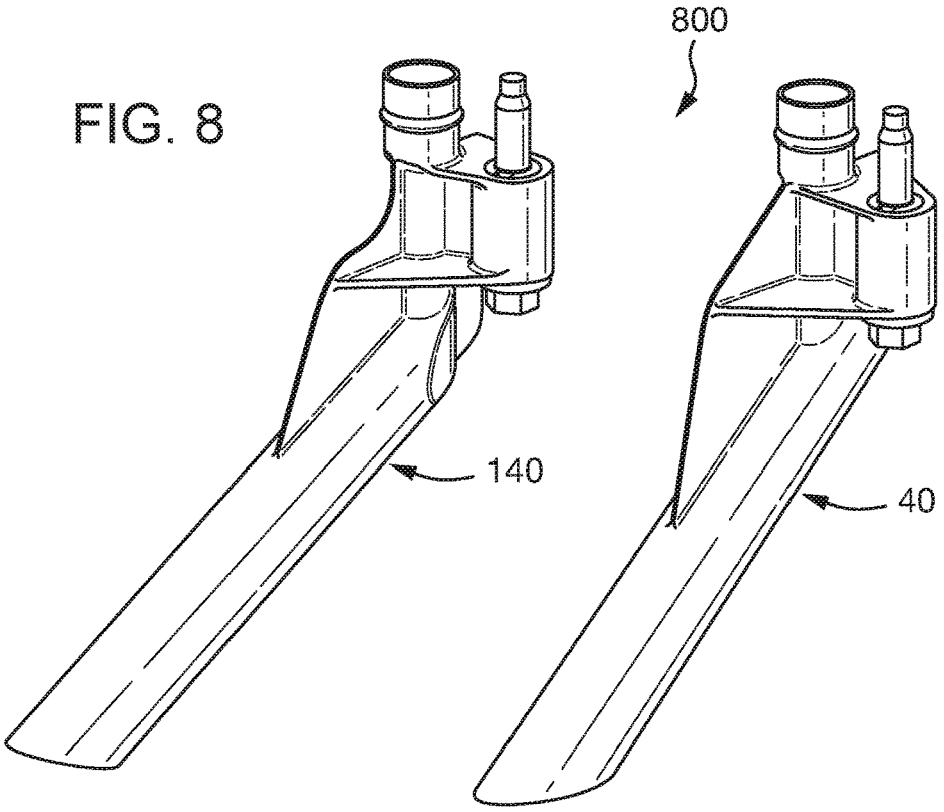
FIG. 8 shows a kit of oil drain pipes according to arrangements of the present disclosure.

With reference to FIG. 8, when assembling the engine assembly 102 or another engine assembly, a kit 800 of oil drain tubes may be provided to be coupled to a ladder frame of the engine assembly, such as the ladder frame 108. The kit 800 may comprise a plurality oil drain tubes. Each of the oil drain tubes may have a first end comprising a fastening portion and a tubular portion, a second end and a tubular body. The configuration, e.g. the size and/or shape, of the first end of a first oil drain pipe in the set may be different from the size and/or shape of the first ends of the or each of the other oil drain pipes in the set. In some arrangements, the configuration of the first ends may vary such that the relative positions of the fastening portion and the tubular portion of the first oil drain tube is different to the relative positions of the fastening portion and tubular portion of the or each of the other oil drain pipes in the kit. For example, as depicted in FIG. 8, the kit 800 may comprise the oil drain tube 40 and the oil drain tube 140.

The kit 800 may therefore be configured such that the first oil drain tube is couplable to one of the oil drain features provided on the ladder frame but is not couplable to the other oil drain features provided on the ladder frame. In some arrangements, each of the oil drain tubes in the kit 800 may be couplable to a different oil drain feature provided on the ladder frame.

Returning to FIGS. 3B and 6B, the fastening portions 42, 142 of the oil drain tubes may comprise a fastener 42*a*, 142*a*, e.g. a bolt or screw, coupled to the first end of the oil drain tube. The fastener may be captive on the first end of the oil drain tube. In other words, the fastener may be permitted to rotate relative to the first end of the drain tube, e.g. to allow the fastener to be threaded into the bore formed on the ladder frame 8, 108, however, the fastener may be prevented from decoupling from the oil drain tube 40, 140 prior to assembly of the engine assembly 2, 102.

Providing a fastener that is captive on the first end of the oil drain tube may allow a technician to quickly determine whether the configuration, e.g. the size, shape and/or relative positions of the fastening portion 42 and the tubular portion of the oil drain tube corresponds to the configuration of an oil drain features of the ladder frame when assembling the engine assembly 2, 102.

The fastener 42*a*, 142*a* may be coupled to a boss 42*b*, 142*b* formed at the first end of the oil drain pipe. The boss 42*b*, 142*b* may extend from the tubular portion 44, 144 to the position of the fastener 42*a*, 142*a*. The boss 42*b* 142*b* may comprise one or more stiffening features, such as webs or ribs, configured to increase the stiffness of the boss and reduce deflections of the tubular portion 44, 144 relative to the fastening portion 42, 142.

Although in the arrangements depicted in FIGS. 1, 2 and 4, 5 the engine assemblies depicted comprise one oil drain channel and two oil drain channels respectively, it is also envisaged that, in other arrangement of the disclosure, the engine assembly may comprise more than two oil drain channels and a corresponding number of oil drain features provided on the ladder frame of the engine assembly. In this case, the engine assembly may comprise a corresponding number of oil drain tubes configured to couple to the oil drain features. When the engine assembly comprises more than two oil drain tubes, the first end of each of the drain tubes may be differently configured, such that each of the oil drain tubes is couplable to one of the oil drain features but is not couplable to the other oil drain features. Alternatively, the first end of two or more than one of the oil drain pipes may be similar, and the first ends of one or more of the oil drain pipes may be configured differently to one or more of the other oil drain pipes.

FIGS. 1-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It will be appreciated by those skilled in the art that although the disclosure has been described by way of example, with reference to one or more examples, it is not limited to the disclosed examples and alternative examples may be constructed without departing from the scope of the disclosure as defined by the appended claims.

The invention claimed is:

1. An engine housing component, the housing component defining two or more drain channels configured to receive oil separated from a crankcase ventilation system and to drain the oil through the housing component, wherein the housing component comprises two or more drain features, each of the drain features corresponding to one of the drain channels, wherein each of the drain features is configured to allow an oil drain pipe to be coupled to the drain feature such that the oil drain pipe is in fluid communication with the corresponding drain channel, wherein a first drain feature differs from the or each of the other drain features, such that a particular oil drain pipe configured to couple to the first drain feature is not couplable to the other drain features.

2. The engine housing component of claim 1, wherein each of the drain features comprises:

a drain port in fluid communication with the corresponding drain channel; and a coupling separate from the drain port, wherein the coupling is configured to allow the oil drain pipe to be coupled to the drain feature.

3. The engine housing component of claim 2, wherein a size and/or a shape of the drain port of the first drain feature is different from a size and/or a shape of the drain port of the other drain features.

4. The engine housing component of claim 3, wherein a size and/or a shape of the coupling of the first drain feature is different from a size and/or a shape of the coupling of the other drain features.

5. The engine housing component of claim 2, wherein a size and/or a shape of the coupling of the first drain feature is different from a size and/or a shape of the coupling of the other drain features.

6. The engine housing component of claim 2, wherein relative positions of the drain port and the coupling of the first drain feature are different from relative positions of the drain ports and the couplings of each of the other drain features.

7. The engine housing component of claim 2, wherein the coupling comprises a bore configured to receive a fastener provided on the drain pipe.

8. An engine housing assembly comprising an engine housing component, the engine housing component defining two or more drain channels configured to receive oil separated from a crankcase ventilation system and to drain the oil through the engine housing component, wherein the engine housing component comprises two or more drain features, each of the drain features corresponding to one of the drain channels, wherein each of the drain features is configured to allow an oil drain pipe to be coupled to the drain feature such that the oil drain pipe is in fluid communication with the corresponding drain channel, wherein a first drain feature differs from the or each of the other drain features, such that a particular oil drain pipe configured to couple to the first drain feature is not couplable to the other drain features; wherein a first oil drain pipe is coupled to the first drain feature, wherein the first oil drain pipe is not couplable to the or each of the other drain features.

9. The engine housing assembly of claim 8, wherein the first oil drain pipe comprises a fastener configured to couple the first oil drain pipe to the first drain feature, and a pipe portion, configured to receive separated oil from the drain channel corresponding to the first drain feature, wherein the first oil drain pipe is configured such that the pipe portion is in fluid communication with the corresponding drain channel when the fastener is coupled to the first drain feature.

10. The engine housing assembly of claim 9, wherein the fastener is captive on the first oil drain pipe prior to assembly.

11. The engine housing assembly of claim 8, wherein the first oil drain pipe has a first end and a second end, wherein the first end is coupled to the first oil drain feature and wherein the first oil drain pipe is configured such that the second end of the first oil drain pipe is positioned within an oil sump at or adjacent to a deepest point of the oil sump.

12. The engine housing assembly of claim 11, wherein the assembly further comprises a second oil drain pipe coupled to a second drain feature of the engine housing component, wherein the second oil drain pipe is not couplable to the first oil drain feature.

13. The engine housing assembly of claim 12, wherein the second oil drain pipe comprises a fastener configured to couple the second oil drain pipe to the second drain feature, and a pipe portion configured to receive separated oil from the drain channel corresponding to the second drain feature, wherein the second oil drain pipe is configured such that the pipe portion is in fluid communication with the corresponding drain channel when the fastener is coupled to the second drain feature.

14. The engine housing assembly of claim 13, wherein a distance between the fastener and the pipe portion of the first oil drain pipe is different from a distance between the fastener and the pipe portion of the second oil drain pipe, and wherein the second oil drain pipe has a first end and a second end, wherein the first end is coupled to the second drain feature and wherein the second oil drain pipe is configured such that the second end of the second oil drain pipe is positioned within the oil sump at or adjacent to the deepest point of the oil sump.

15. The engine housing assembly of claim 12, wherein the second oil drain pipe has a first end and a second end, wherein the first end is coupled to the second drain feature and wherein the second oil drain pipe is configured such that the second end of the second oil drain pipe is positioned within the oil sump at or adjacent to the deepest point of the oil sump.

16. A kit of oil drain pipes for coupling to an engine housing component, the oil drain pipes being configured to couple to an oil drain feature of the housing component to allow oil separated from a crankcase ventilation system to drain through a drain channel defined in the housing component into the oil drain pipe, wherein each of the oil drain pipes has a first end comprising a fastening portion configured to couple the oil drain pipe to the oil drain feature and a pipe portion configured to receive the separated oil from the drain channel, wherein a size and/or a shape of the first end of a first oil drain pipe is different from a size and/or a shape of the first end of other oil drain pipes in the kit.

17. The kit of claim 16, wherein relative positions of the fastening portion and the pipe portion of the first oil pipe are different from the other oil drain pipes in the kit.

18. The kit of claim 16, wherein the fastening portion comprises a fastener provided on the oil drain pipe, wherein the fastener is captive on the oil drain pipe prior to coupling to the oil drain feature.

19. The kit of claim 18, wherein the fastener is provided on a boss formed integrally with the pipe portion of the oil drain pipe.

20. A system comprising an engine housing component defining drain channels configured to drain PCV oil through drain features corresponding thereto, each drain feature configured to allow an oil drain pipe to be coupled thereto to form fluid communication with a corresponding drain channel, a first drain feature differing from another drain feature such that a particular oil drain pipe configured to couple to the first drain feature is not couplable to the another drain feature.

* * * * *